United States Patent [19]

Lüthi

[11] 4,204,394

[45] May 27, 1980

[54] DEVICE RELATING TO APPARATUS FOR TEXTURING TEXTILE YARNS

[75] Inventor: Walter Lüthi, Ebnat-Kappel, Switzerland

[73] Assignee: Heberelein Maschinenfabrik AG, Wattwil, Switzerland

[21] Appl. No.: 3,772

[22] Filed: Jan. 11, 1979

[30] Foreign Application Priority Data

Jan. 12, 1978 [CH] Switzerland ..... 306/78
Jan. 25, 1978 [CH] Switzerland ..... 782/78

[51] Int. Cl.[2] ..... D01H 7/92; D01H 13/04; D02G 1/04

[52] U.S. Cl. ..... 57/334

[58] Field of Search ..... 57/332, 334, 337–340, 57/348

[56] References Cited

U.S. PATENT DOCUMENTS 3,287,890 11/1966 McIntosh ..... 57/339
3,327,463 6/1967 Niina ..... 57/337
4,010,599 3/1977 Luthi ..... 57/334 X
4,027,467 6/1977 Smith ..... 57/337 X

*Primary Examiner*—Donald Watkins
*Attorney, Agent, or Firm*—Young & Thompson

[57] ABSTRACT

Apparatus for friction texturing textile yarns includes a cylinder (1) rotatable about its longitudinal axis on a base plate (2). The outer surface of the cylinder has regularly spaced friction surfaces (3) with grooves therebetween, and a spirally shaped outer cover (6) containing pegs (5) which project radially into the cylinder and engage grooves (4). The cover (6) has a cylindrical collar (10) having a yarn guide (9), the collar being movable along the axis of the cylinder and held in a desired position with a set screw (11). The top of the cylinder (1) is covered with a disc (13) having a projecting annular flange.

Yarn is guided round the cylinder (1) by the pegs (5) and false twist by friction is imparted to the yarn.

7 Claims, 3 Drawing Figures

DEVICE RELATING TO APPARATUS FOR TEXTURING TEXTILE YARNS

This invention relates to apparatus for texturing textile yarns of thermoplastic material by imparting false twist by friction.

Swiss Pat. No. 987,386 describes apparatus of this type comprising a cylinder rotating about its own axis and serving as the friction element, the outside of which features evenly spaced friction surfaces at right angles to the axis of the cylinder with grooves between the surfaces, an outer cover surrounding the cylinder having a series of yarn guides in the form of small pegs projecting radially into the cylinder, the free ends engaging in the grooves whereby the line connecting the points of engagement of the yarn guides in the grooves describes a helical path, and a compensating tensioner which is influenced by the tension of the yarn entering and leaving the cylinder. The compensating tensioner may comprise a movable yarn guide located at the yarn-entry end of the cylinder and capable of being moved in the direction of the axis and the circumference of the clinder and along the full length of the cylinder, and a fixed yarn guide being located at the yarn-exit end of the cylinder and two tensiometers, one being associated with each yarn guide. Any modification of the twist density of the yarn being textured for whatever reason during operation will cause a deviation of the yarn tensions between the movable and fixed yarn guides, this being measured by the tensionmeters and corrected by shifting the movable yarn guide.

The disadvantage of the compensating tensioner is that it calls for the use of additional elements that not only make the complete apparatus relatively complicated and expensive, but also prevent the free threading of the friction element in any desired position of the movable yarn guide.

The object of the invention is to overcome some of the above-mentioned disadvantages and to provide apparatus for friction texturing on the false-twist principle of relatively simple design, which permits free threading of the friction element.

Broadly stated, the invention consists in apparatus for friction texturing textile yarns of thermoplastic material using the false-twist principle, comprising a cylinder rotatable about its longitudinal axis on a base, the outer surface of the cylinder being provided with spaced friction surfaces substantially at right angles to the axis of the cylinder and grooves between the surfaces, an outer cover surrounding the cylinder and having a plurality of yarn guides which project inwardly into the cylinder and engage the grooves, the points of engagement of the yarn guides with the grooves being on a helical path around the cylinder, the base having a yarn guide and the upper end of the cylinder having a plate with a projecting edge for guiding the yarn.

Preferably a collar to which a yarn guide is fitted is arranged around the outer cover, the internal diameter of the collar being substantially equal to the external diameter of the outer cover, the collar being slidable along the surface of the outer cover and being held in a desired position by means of a retaining member.

The surface of the cylinder may carry a scale for setting the position of the collar.

In a preferred embodiment of the invention, a first tensiometer is located on the base adjacent the base yarn guide, and a second tensiometer is located on the collar adjacent the collar yarn guide.

The apparatus of the invention may further be provided with a difference amplifier, coupled to the tensiometers, for controlling a servomotor responsible for moving the collar along the outer cover.

The invention may be performed in various ways and a specific embodiment, with one variation, will now be described by way of example with reference to the accompanying drawings, in which.

Figure 1:
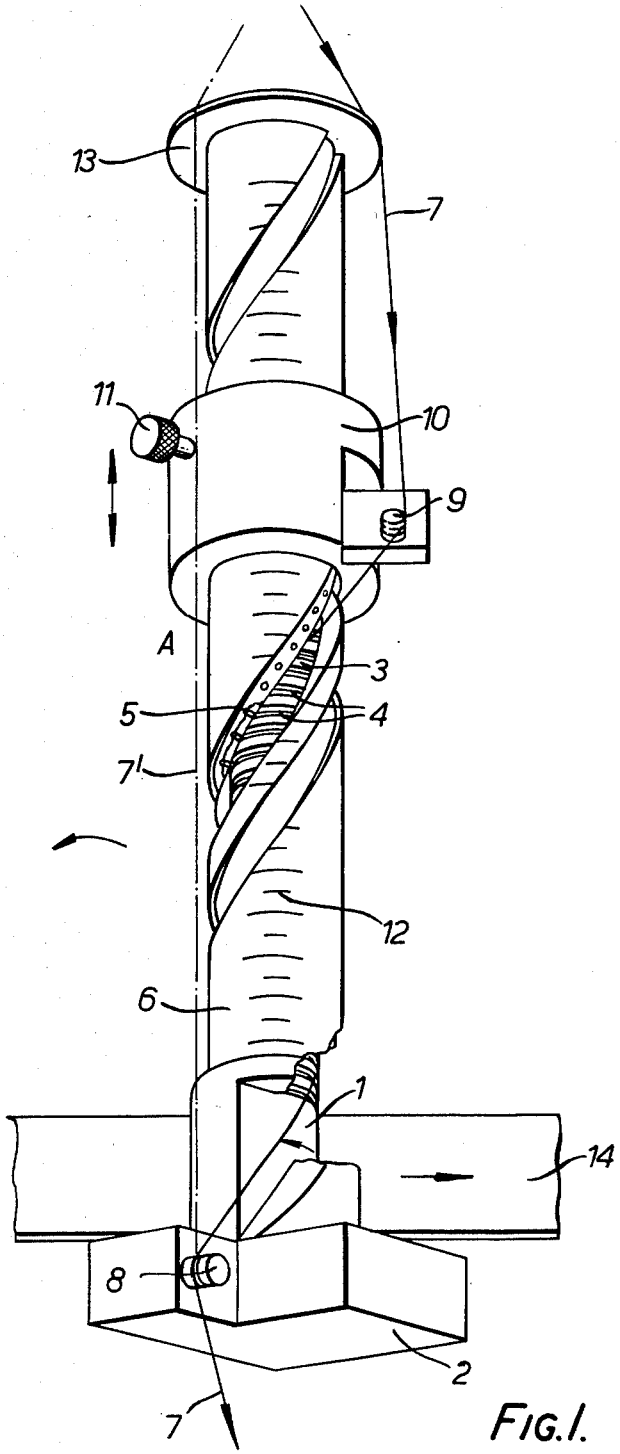
FIG. 1 is a perspective view of one embodiment of the invention.

FIG. 1 of the drawings shows a twist element comprising a vertical cylinder 1 rotatable about its own axis and located on a base plate 2 to which a yarn guide 8 is fitted and which is mounted on a machine frame (not shown). The cylinder 1 is driven by a belt 14, and has a smooth surface where it is in contact with the belt. The remaining sections of the cylinder are provided with regularly spaced friction surfaces 3 preferably consisting of polyurethane coatings. A series of grooves 4 is located between the friction surfaces, and a spirally shaped outer cover 6 surrounds the cylinder and contains a series of yarn guides consisting of pegs 5 projecting radially into the cylinder 1 and engaging in each groove 4. The pegs 5 are interchangeably mounted in the outer cover 6, their points of engagement in the grooves 4 describing a helical path.

The outer cover 6 is provided with a cylindrical collar 10 having a yarn guide 9, the collar being movable along the axis of the cylinder and held in a desired position with the set screw 11. The surface of the outer cover 6 is further provided with a scale 12 for setting the position of the collar 10, and an end disc 13 having an annular flange is located at the upper end of cylinder 1.

Before threading-up the device, the collar 10 is set at a position for producing the desired twist density with a given surface velocity of the cylinder 1 and delivery speed of the yarn. Following the processing zone (not shown), and before starting up the device, the yarn 7 to be textured is taken around the flange of the end disc 13 direct to the yarn guide 8, as shown by the dash-dotted line 7', from which point the yarn 7 is passed to delivery rolls (not shown). The yarn 7 is then manually grasped at point A with the aid of a hook (not shown) and drawn so that it is wrapped around the cylinder 1 following a helical path, determined by the pegs 5, and passed around the yarn guide 9 on the collar 10. After starting up the device, the yarn 7 is, by contact with the friction surfaces 3, pressed against the pegs 5 which are spaced at intervals of 0.5 cm, the deflection of the yarn between the pegs being minimized and the working thread-line deviating at no point by more than 3° from the helical path, determined by the pegs.

A special advantage of the device of the illustrated embodiment is that the yarn has a large scale angle of wrap, but a very small angle of curvature around the friction surfaces, thereby permitting very gentle handling of the yarn. A similar effect is produced by the very low force with which the yarn is pressed against the pegs acting as yarn guides. The device makes it possible to texture yarns at delivery rates of 1000 m/min and over.

Figure 2:
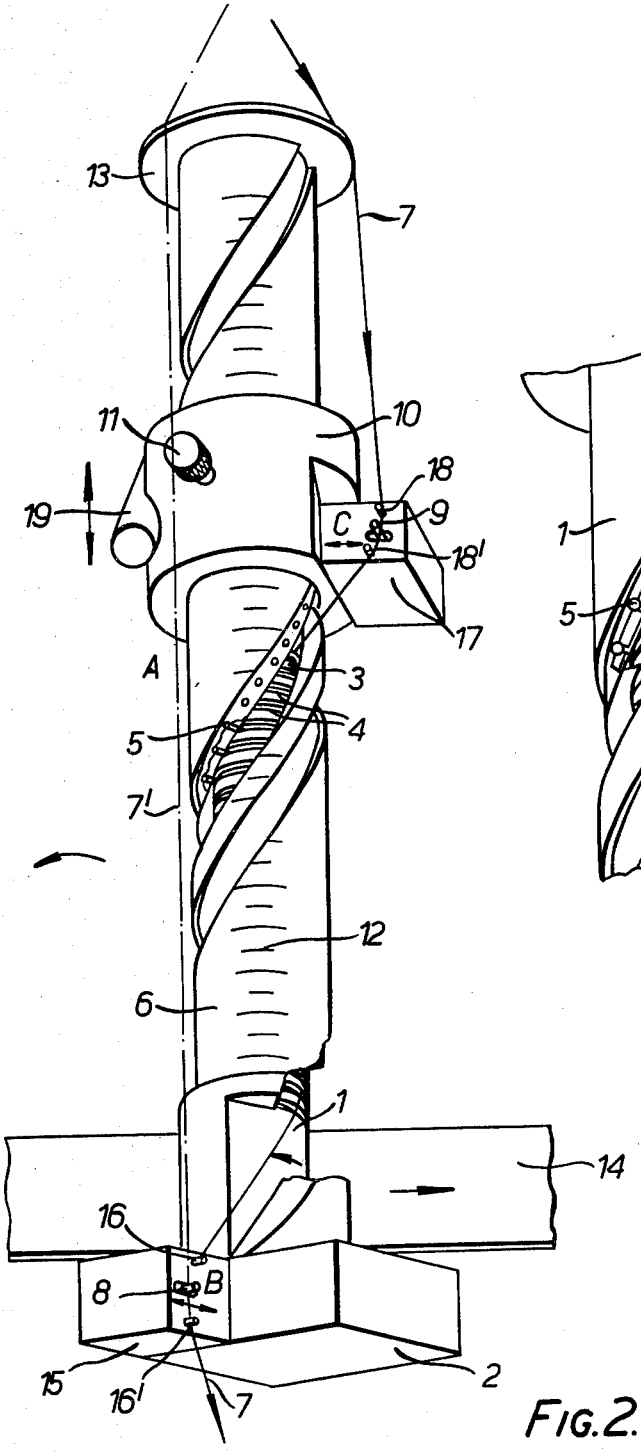
FIG. 2 is a perspective view of an alternative embodiment of the invention.
Figure 3:
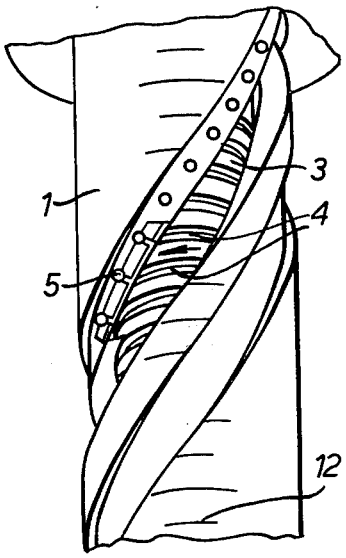
FIG. 3 is an enlarged representation of a detail of FIG. 1.

FIG. 2 shows an alternative form of the device, having a yarn tensiometer 15 with the yarn guides 16,16' on the base plate 2 besides the yarn guide 8 to which it is associated. The collar 10, mounted on the outside of the outer cover 6, can be moved along the axis and the circumference of the cylinder with the aid of the servomotor 19 or by hand. Each yarn guide 8, 9 is provided with a groove and is spring-loaded so that, with the aid of the associated tensiometer 15 or 17, the yarn tension can be measured.

The threading-up and starting-up operations for the device of FIG. 2 are performed in exactly the same manner as for the device of FIG. 1. Any modification of the twist density of the yarn 7 for any reason causes a deviation of the yarn tensions between the yarn guides 8 and 9, being measured by the tensiometers 15,17. The position of the hollow cylinder 10 is shifted through a difference amplifier, not represented, coupled to the tensiometers 15,17, by a servomotor 19 for correcting to the desired twist density. Furthermore, the deviation of the yarn tensions is measured at the yarn guides 8 and 9 and may be employed for controlling a yarn monitoring system triggering the serving of the yarn in the event that tensions of the yarn exceed or fall below the tolerance limits.

I claim:

1. Apparatus for friction texturing textile yarns of thermoplastic material using the false-twist principle, comprising a base, a cylinder rotatable about its longitudinal axis on said base, spaced friction surfaces on the outer surface of said cylinder and at right angles to the axis of said cylinder, grooves between said surfaces, an outer cover surrounding said cylinder, a plurality of yarn guides projecting inwardly into said cylinder and engaging said grooves, the points of engagement of the yarn guides with said grooves being on a helical path around said cylinder, a yarn guide on said base, and a plate on the upper end of said cylider, said plate having a projecting edge for guiding the yarn.

2. Apparatus according to claim 1, including a collar arranged around the outer cover, the internal diameter of the collar being substantailly equal to the external diameter of the outer cover, the collar being slidable along the surface of the outer cover, a retaining member for holding the collar in a desired position, and a yarn guide fitted to the collar.

3. Apparatus according to claim 2 in which said retaining member is a set screw.

4. Apparatus according to claim 2 including a scale on the surface of the outer cover for setting the position of the collar.

5. Apparatus according to claim 2 in which a first tensiometer is located on the base adjacent the base yarn guide, and a second tensiometer is located on the collar adjacent the collar yarn guide.

6. Apparatus according to claim 5, in which a difference amplifier is coupled to the tensiometers for controlling a servomotor responsible for moving the collar along the outer cover.

7. Apparatus according to claim 1 in which the yarn guides on the outer cover are in the form of pegs.

* * * * *